US007370706B2

(12) United States Patent
Becker et al.

(10) Patent No.: US 7,370,706 B2
(45) Date of Patent: May 13, 2008

(54) GAS LIFT VALVE FOR HIGH PRESSURE OPERATION

(76) Inventors: Billy G. Becker, P.O. Box 25330, Ventura, CA (US) 93002; David A. Tucker, P.O. Box 25330, Ventura, CA (US) 93002

( * ) Notice: Subject to any disclaimer, the term of this patent is extended or adjusted under 35 U.S.C. 154(b) by 118 days.

(21) Appl. No.: 11/278,244

(22) Filed: Mar. 31, 2006

(65) Prior Publication Data

US 2007/0227739 A1 Oct. 4, 2007

(51) Int. Cl.
*E21B 34/10* (2006.01)

(52) U.S. Cl. ..... 166/372; 166/373; 137/155

(58) Field of Classification Search ..... 166/321, 166/372, 373, 374, 380; 137/155; 417/112, 417/115, 117

See application file for complete search history.

(56) References Cited

U.S. PATENT DOCUMENTS 3,225,783 A * 12/1965 Stacha ..... 137/155
3,318,322 A * 5/1967 Garrett ..... 137/155
3,834,414 A * 9/1974 McMurry ..... 137/155
3,888,273 A * 6/1975 Douglas ..... 137/155
4,111,608 A * 9/1978 Elliott et al. ..... 417/112
4,592,380 A * 6/1986 Hamm ..... 137/155
4,625,941 A * 12/1986 Johnson ..... 251/12
5,170,815 A * 12/1992 Going et al. ..... 137/155
6,932,581 B2 * 8/2005 Messick ..... 417/54
2006/0043683 A1 * 3/2006 Ocalan ..... 277/636

* cited by examiner

*Primary Examiner*—Jennifer H. Gay
*Assistant Examiner*—Daniel P Stephenson
(74) *Attorney, Agent, or Firm*—Locke Lord Bissell & Liddell LLP

(57) ABSTRACT

A unique gas lift valve bellows assembly in which an internal piston incorporated within the bellows provides over travel prevention and over pressure protection during valve operation, independent of the set or operating gas pressures exerted on the gas lift valve. The piston separates a hydraulic damping reservoir in the interior convolutions of the bellows from the upper gas volume chamber. The piston travels a pre-set distance between two stops to provide a fluid dampened hydraulic balance across the bellows convolutions in both the open and closed positions of the valve. This results in a long lived bellows valve that can operate with any pressure up to the limits of the material, without overstressing the bellows.

21 Claims, 2 Drawing Sheets

GAS LIFT VALVE FOR HIGH PRESSURE OPERATION

BACKGROUND OF THE INVENTION

1. Field of the Invention

This invention relates generally to gas lift valves for the artificial production from oil and gas wells and, more particularly, to gas lift valves capable of operating at high differential pressures.

2. Description of Related Art

Gas lift valves have been used for many years to inject compressed gas into oil and gas wells to assist in the production of well fluids to the surface. The valves have evolved into devices in which a metal bellows, of a variety of sizes, converts pressure into movement. This allows the injected compressed gas to act upon the bellows to open the valve, and pass through a control mechanism into the fluid fed in from the well's producing zone into the well bore. As differential pressure is reduced on the bellows, the valve can close. Two types of gas lift valves use bellows. The first uses a non-gas charged, atmospheric bellows and requires a spring to close the valve mechanism. The other mechanism uses an internal gas charge, usually nitrogen, in the bellows and volume dome to provide the closing force for the valve. In both valve configurations, pressure differential on the bellows from the injected high pressure gas opens the valve mechanism.

In the case of the non-gas charged bellows, the atmospheric pressurized bellows is subjected to high differential pressures when the valve is installed in a well and exposed to high operating gas injection pressure. The nitrogen charged bellows is subject to high internal bellows pressure during setting and prior to installation. Once installed, the differential pressure across the bellows is less than in a non-gas charged bellows during operation of the valve. High differential pressure across a bellows during operation reduces the cycle life of the bellows. The existing gas lift valves and bellows are not designed to operate with set pressures or in operating pressures in excess of 2000 psig without severe failure risks. Some existing valve bellows do have some fluid and/or mechanical protection for overpressure due to operating pressures in the fill open position. However, none provide for protection from differential overpressure from the set pressure in the bellows.

SUMMARY OF THE INVENTION

The present invention comprises a gas-charged gas lift valve wherein the bellows of the gas lift valve are protected from high differential pressure. A piston is disposed in a central bore of a sleeve in the bellows. The piston separates a hydraulic damping reservoir in the interior convolutions of the bellows from the upper gas volume chamber containing the gas charge. The piston can only travel a pre-set distance in the internal bore between two stops. When operating pressure exerted on the bellows from the injected gas exceed the pressure of the gas charge in the upper gas chamber, the piston is pushed to contact the upper stop. More of the hydraulic dampening fluid is allowed to exit the interior of the bellow convolutions and move into the central bore of the internal sleeve. This allows the pressure from the injected gas to move the bellows into a contracted position to open the valve. Once the piston has reached the top position, the incompressible nature of the hydraulic fluid protects the bellows from any further increase in external pressure as well as further contraction due to that pressure.

When the operating pressure of the injected gas drops below the pressure of the upper gas chamber, the gas in the upper gas chamber pushes the piston to the lower stop. This forces more of the hydraulic dampening fluid in the interior of the bellow convolutions, extending the bellows and closing the valve. Once the piston reaches the bottom position, the incompressible nature of the hydraulic fluid prevents the bellows from further extension and prevents a large pressure differential across the bellows.

The bellows design in the disclosed invention provides a fluid dampened hydraulic balance across the bellows convolutions in both the open and closed positions of the valve. It also preferably eliminates pressure differentials in excess of the natural spring rate of the bellows materials and any small compression resistance of the nitrogen charged gas in the dome/bellows volume. Since this new device prevents high differential pressure across the convolutions of the bellows, the valve can preferably be charged with any pressure up to the limits of the materials and can be run in any operating pressure up to the limits of the materials, without overstressing the bellows. This can provide a long lived bellows operation, approaching the life cycle ratings of the bellows manufacturer under low stressed conditions. The new bellows device can also preferably be retrofitted into existing gas lift valve configurations.

BRIEF DESCRIPTION OF THE DRAWINGS

The apparatus of the invention is further described and explained in relation to the following figures wherein.

DESCRIPTION OF THE PREFERRED EMBODIMENT

Various aspects and relationships of a preferred embodiment of the current invention will be described in the context of what is commonly known to the industry as a casing sensitive one inch wire line retrievable gas lift valve. It is within the scope of this patent to apply the present invention to other sizes and configurations of gas lift valves, both wire line retrievable and tubing retrievable gas lift valves and both injection pressure operated (IPO) or production pressure operated (PPO) valves.

Figure 1:
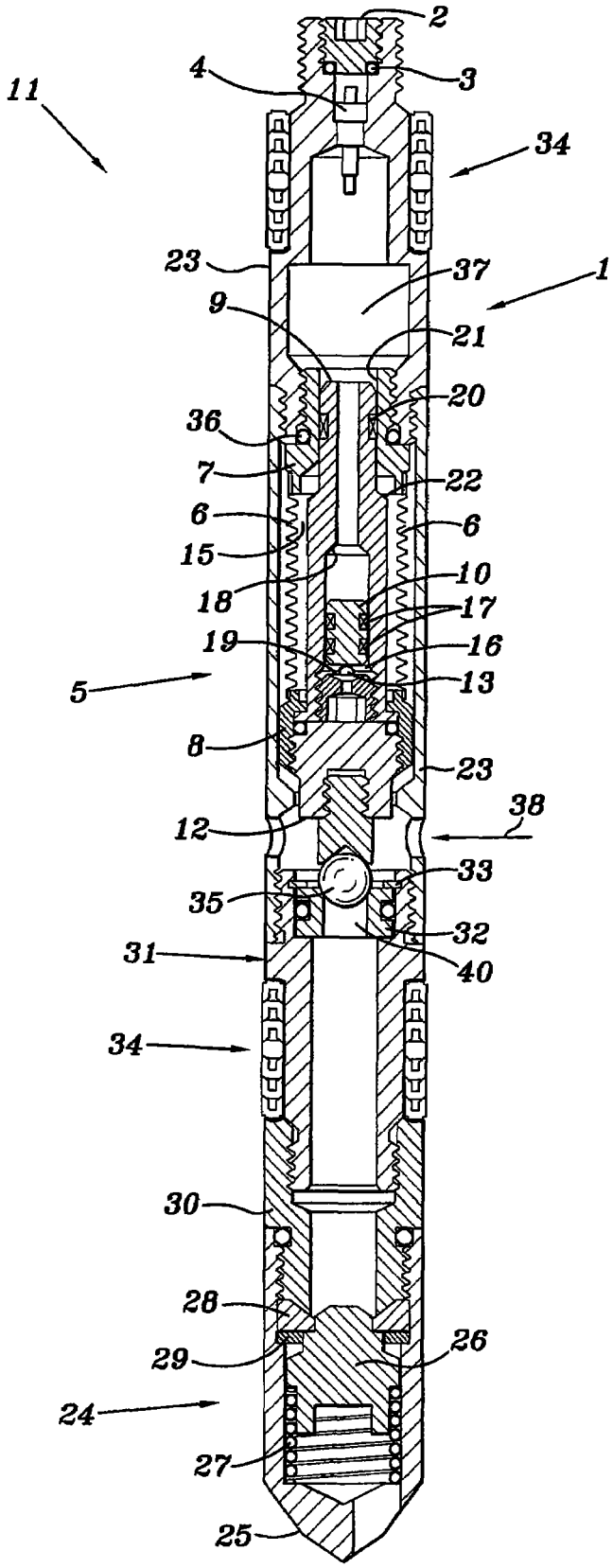
FIG. 1 is a cross-sectional view of a typical wire line retrievable high pressure gas lift valve of the preferred embodiment.

FIG. 1 illustrates a gas lift valve 11 into which the present invention has been adapted. The valve 11 consists first of an upper chamber 1, which includes a tail plug 2, a sealing gasket 3, a core valve 4, and a set of external seals 34 employed to pack off the valve in the upper seal bore of an appropriate side pocket gas lift mandrel common to the industry and not illustrated herein. The upper chamber 1 is attached by means of a threaded connector or other suitable means to the improved metal bellows assembly 5 of the present invention, and is enclosed by a ported bellows housing 23.

The improved metal bellows assembly 5 of the present invention consists of a metal bellows 6, an upper bellows adaptor 7, a lower bellows adaptor 8, an internal ported sleeve 9, a piston 10, an adjustment screw 19, and a stem adaptor 12, to which is attached a stem 35. The metal bellows 6 is attached to the upper bellows adaptor 7 and the lower bellows adaptor 8 by any of the means of soldering, brazing, or welding to produce a strong hermetic seal between the metal bellows 6 and the upper and lower bellows adaptors 7, 8. The improved metal bellows assembly 5 is sealed to the upper chamber 1 by the use of O-rings 36 or any other suitable means.

The internal ported sleeve 9 has a small fluid port 13 through which hydraulic fluid is able to communicate from the annulus 15 created by the internal ported sleeve 9 and the interior of the metal bellows 6 to the internal seal bore 16 of the internal ported sleeve 9, and to act upon the piston 10. The piston 10 having external resilient seals 17 is located in the internal seal bore 16 of the internal ported sleeve 9 and is allowed to travel between the upper travel stop 18 and the lower travel stop 19. Lower travel stop 19 can optionally be an adjustment screw. The use of an adjustment screw as travel stop 19 allows the range of movement of piston 10 to be limited and thus the amount of extension of bellows 6. The internal ported sleeve 9 also has external seals 20 to seal it to the internal seal bore 21 of the upper bellows adaptor 7, an upper travel stop shoulder 22, and is allowed to travel within the upper adaptor 7 within travel limits imposed by the upper travel stop shoulder 22 and the piston's lower travel stop 19.

Figure 2:
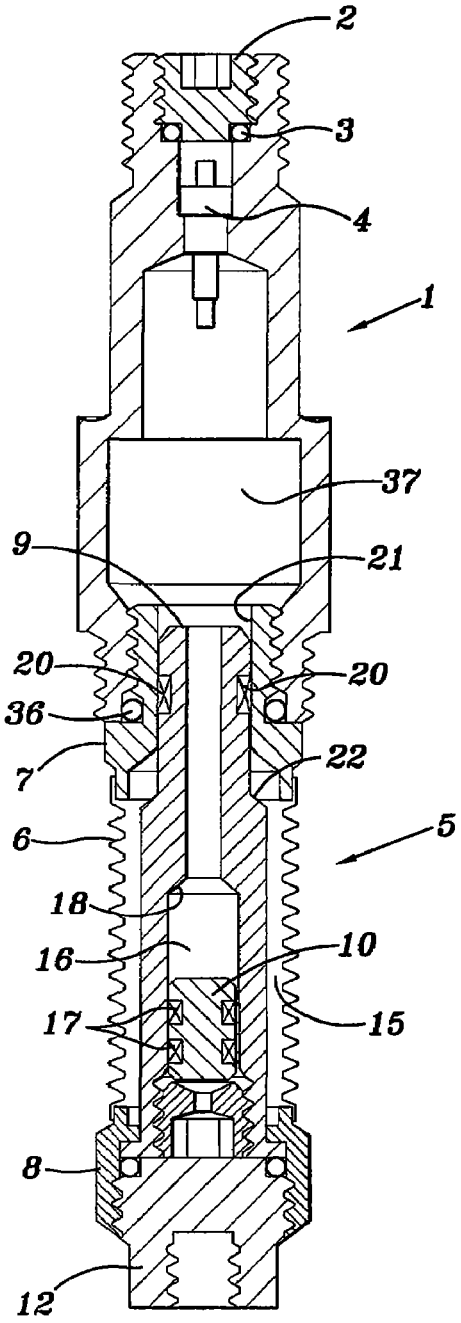
FIG. 2 is a cross sectional view of the upper chamber of the preferred embodiment illustrated in the fully extended position with the piston located at the lower travel stop.
Figure 3:
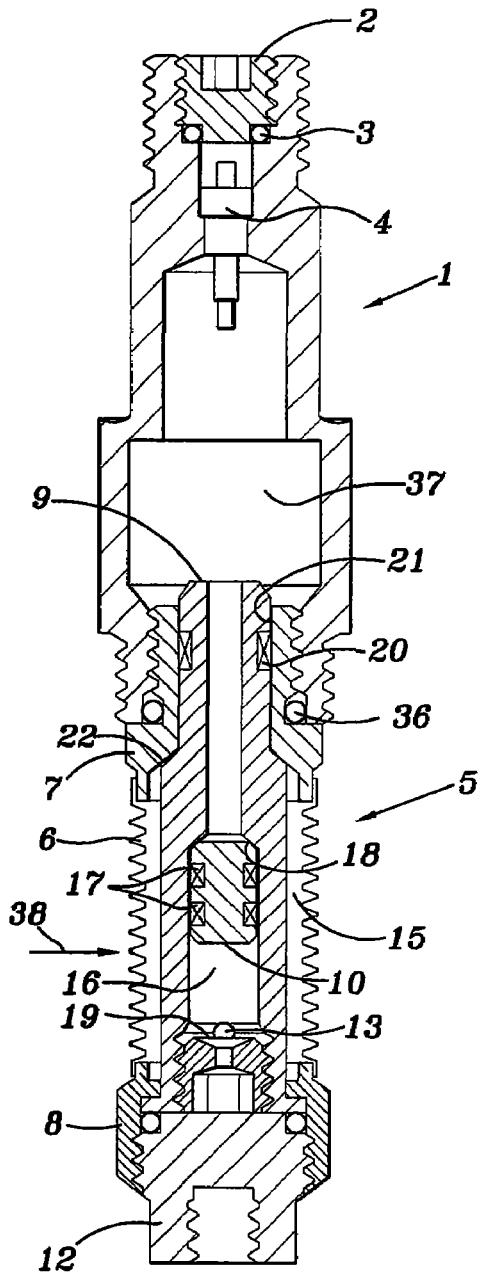
FIG. 3 is a cross sectional view of the upper chamber of the preferred embodiments from FIG. 1, illustrated in the fully contracted condition with the piston located at the upper travel stop.

Upper chamber 1 contains compressed gas, typically nitrogen, in chamber 37 that exerts a downward force upon the piston 10. This pushes the piston 10 downward forcing the incompressible hydraulic fluid located in the internal seal bore 16 below the piston 10 in an external direction through the small fluid port 13 and into the annulus 15 created by the internal ported sleeve 9 and the interior surface of the metal bellows 6. Increased hydraulic fluid in annulus 15 causes the metal bellows 6 to extend. FIG. 2 will illustrate this condition. Compressed gas 38 from the casing-tubing annulus (not illustrated) injected from the surface wellhead provides a counteracting force on the external surface of the metal bellows 6. When the force of compressed gas 38 is larger than the downward force upon the piston 10 of the compressed gas located in chamber 37, the metal bellows 6 contract. FIG. 3 will illustrate this condition.

The gas lift valve 11 of the preferred embodiment further comprises a stem adapter 12 secured to the lower bellows adapter 8. Stem 35 is secured in stem adapter 12 and is positioned proximate to seat 32. Upon extension of bellows 6, lower bellows adapter 8, and thus stem adapter 12, and stem 35 are translated toward seat 32. When bellows 6 are fully extended, stem 35 is seated in seat 32, thereby preventing injection gas 38 from passing through opening 40. This represents the 'closed' position of valve 11. Upon contraction of bellows 6, lower bellows adapter and thus stem adapter 12 and stem 35 are translated away from seat 32. This allows injection gas 38 to pass through opening 40 and out through nose cap 25 of valve 11. This represents the 'open' position of valve 11.

As shown in FIG. 1, the gas lift valve 11 of the preferred embodiment further consists of a check valve assembly 24 common to the industry. Check valve assembly 24 comprises a nose cap 25, and back check dart 26, a spring 27, a resilient seal 28, a seal support washer 29, and a back check adaptor 30. The valve further consists of a lower packing adaptor 31, in which is also located a seat 32 and a retaining ring 33 to capture the seat in the lower packing adaptor, and on which is located a set of external seals 34 employed to pack off the valve in the lower seal bore of an appropriate side pocket gas lift mandrel common to the industry and not illustrated herein.

FIG. 2 illustrates the upper chamber 1 and improved metal bellows assembly 5 of the present invention with the bellows 6 in the fully extended condition and the internal piston 10 located against the lower travel stop 19. Optionally, the lower travel stop 19 may be an adjustable screw to provide additional control over the distance that the piston 10 can move in internal sleeve 9. The fully extended condition of the improved metal bellows assembly 5 is obtained when the pressure exerted upon the internal surfaces of the metal bellows 6 exceeds the pressure exerted upon the external surfaces of the metal bellows 6.

The pressure of the compressed gas in the chamber 37 acts upon the area of the external seals 20 on the internal sleeve 9 and the external resilient seals 17 on the piston 10 to provide a downward force that tends to extend the metal bellows 6 and move the piston 10 downward. As the piston 10 travels downward in the internal seal bore 16 of the internal ported sleeve 9, it forces the hydraulic fluid in the internal seal bore 16 through the small fluid port 13 and into the annulus 15 created by the exterior of the internal ported sleeve 9 and the interior surface of the metal bellows 6. The pressure transferred to the internal surface of the metal bellows 6 by the displaced hydraulic fluid 14 causes the metal bellows 6 to extend. When the piston 10 travels to and is stopped by the lower travel stop 19 in this embodiment, no further hydraulic fluid 14 may be displaced into the annulus 15 created by the internal ported sleeve 9 and the interior surface of the metal bellows 6, thereby protecting the metal bellows 6 from any further increase in internal pressure, and thus also from any further extension or increased internal forces which would otherwise overstress the metal bellows 6.

When the improved metal bellows assembly 5 is in the fully extended position, less a small predetermined distance, and the piston 10 is within the same small predetermined distance from the lower travel stop 19, stem 35 first contacts and seals to the seat 32, thereby preventing injected gas 38 from passing through the valve 11. The inherent diametric flexibility of the metal bellows allows the piston 10 to continue until it contacts the lower travel stop 19. Once the piston 10 contacts the lower travel stop 19 any further extension of the metal bellows 6 is restricted due to the incompressibility of the contained hydraulic fluid in annulus 15.

FIG. 3 illustrates the preferred embodiment of the present invention in the fully contracted condition, with the upper travel stop shoulder 22 of the internal ported sleeve 9 against the upper bellows adaptor 7 and the internal piston 10 located against the upper travel stop 18. The fully contracted condition of the improved metal bellows assembly 5 is obtained when the pressure of injected gas 38 exerted upon the external surfaces of the metal bellows 6 exceeds the pressure exerted upon the internal surfaces of the metal bellows 6 from the compressed gas in chamber 36. This would occur when the pressure of the injected gas 36 is raised above a certain threshold.

When the pressure of the injected gas 38 is above the threshold, it forces the metal bellows 6 to contract, thus displacing the hydraulic fluid 14 from the annulus 15 created by the exterior of the internal ported sleeve 9 and the interior surface of the metal bellows 6 and into the internal seal bore 16 of the internal ported sleeve 9. The increased amount of hydraulic fluid 14 in the internal seal bore 16 forces the piston 10 in an upward direction, until it reaches the upward travel stop 18. The contraction of the metal bellows also moves internal sleeve 9 upward until a shoulder 22 on internal sleeve contacts upper bellows adapter 7. This raises stem 35 off of seat 32, thereby allowing injected gas 38 to pass through the valve. Upon reaching the upward travel stop 18, the piston 10 creates an impassable barrier for the hydraulic fluid in internal seal bore 16. The incompressible hydraulic fluid remaining in annulus 15 thereby protects the bellows from any further increase in external pressure, and thus also from any further contraction or increased external forces which would otherwise overstress the metal bellows 6.

The above descriptions of certain embodiments are made for the purposes of illustration only and are not intended to be limiting in any manner. Other alterations and modifications of the preferred embodiment will become apparent to those of ordinary skill in the art upon reading this disclosure, and it is intended that the scope of the invention disclosed herein be limited only by the broadest interpretation of the appended claims to which the inventor is legally entitled.

What is claimed is:

1. A gas lift valve capable of withstanding high differential pressure comprising:

bellows containing a plurality of convolutions, wherein the bellows can contract and expand;

an upper adapter secured to a first end of the bellows and containing a charge of gas;

a lower adapter connected to a second end of the bellows;

a sleeve disposed within the bellows, a first end of the sleeve secured to the lower adapter, and a second end slidably disposed through the upper adapter;

a central bore in the sleeve, wherein a first end of the central bore is in fluid communication with the charge of gas in the upper adapter;

a piston with an external seal slidably disposed in the internal bore of the sleeve;

a first and second travel stop limiting the movement of the piston within the bore, wherein the first travel stop is located toward the first end of the central bore and the second travel stop is located toward the second end of the central bore;

a longitudinal fluid port at the second end of the sleeve providing fluid communication between the inside of the convolutions of the bellows and the internal bore of the sleeve;

an incompressible fluid located inside the convolutions of the bellows;

wherein upon contraction of the bellows, the piston travels to the first travel stop, allowing more of the incompressible fluid to move from the interior of the bellows convolutions to the central bore through the fluid port;

wherein upon extension of the bellows, the piston travels to the second travel stop, forcing more of the incompressible fluid from the central bore into the interior convolutions of the bellows;

a fluid selected from the group consisting of an injection gas and a well fluid, wherein the fluid is located exterior of the bellows and provides an external pressure on the bellows;

wherein the amount of incompressible fluid in the interior bellows convolutions when the piston is at the first and second travel stops is sufficient to provide an internal pressure that is approximately the same as the exterior pressure on the bellows from the injection gas.

2. The gas lift valve of claim 1 wherein the valve is opened when the external pressure is greater than the pressure of the internal charge of gas and the valve is closed when the external pressure is less than the pressure of the internal charge of gas.

3. The gas lift valve of claim 2 further comprising a shoulder on the sleeve, wherein the shoulder limits the contraction of the bellows by contacting the upper adapter.

4. The gas lift valve of claim 2 further comprising a valve stem secured to the lower adapter, a valve seat disposed adjacent to the valve stem, wherein upon extension of the bellows, the valve stem seats in the valve seat, closing the valve and upon contraction of the bellows, the valve stem disengages from the valve seat, opening the valve.

5. The gas lift valve of claim 1 wherein the gas lift valve is a tubing retrievable valve.

6. The gas lift valve of claim 1 wherein the gas lift valve is a wire line retrievable valve.

7. The gas lift valve of claim 1 wherein the lower travel stop is an adjustable screw, wherein the adjustable screw can be adjusted to limit the travel of the piston.

8. The gas lift valve of claim 1 wherein the upper adapter further comprises, a chamber which contains the charge of gas, a core valve, and an external seal to seal the valve in an upper bore of a side pocket gas lift mandrel.

9. The gas lift valve of claim 1 wherein the bellows are metal.

10. The gas lift valve of claim 1 further comprising a lower packing adapter comprising an external seal to seal the valve in a lower bore of a side pocket gas lift mandrel and the seat.

11. The gas lift valve of claim 10 further comprising a check valve assembly secured to the lower packing adapter.

12. The gas lift valve of claim 1 wherein when the piston is at the first travel stop it prevents movement of the incompressible fluid to the interior of the bellows though the fluid port.

13. The gas lift valve of claim 1 wherein when the piston is at the second travel stop it prevents movement of the incompressible fluid from the interior of the bellows through the fluid port.

14. A gas lift valve capable of withstanding high differential pressure comprising:

bellows containing a plurality of convolutions, wherein the bellows can contract and expand;

an incompressible fluid located in the interior of the bellows convolutions providing an interior pressure;

a reservoir in fluid communication with the interior of the bellows convolutions;

a fluid selected from the group consisting of an injection gas and a well fluid, wherein the fluid is exterior to the bellows and provides an exterior pressure;

piston means located within the bellows for moving a portion of the incompressible fluid between the interior of the bellows convolutions and the reservoir to maintain the interior pressure that is approximately the same as the exterior pressure;

wherein the reservoir is a portion of a central bore in a sleeve located within the bellows and a longitudinal port provides fluid communication between the reservoir and the interior of the bellows convolutions.

15. The gas lift valve of claim 14 wherein the piston means is a piston with an external seal slidably disposed within the central bore of the sleeve between a first and second travel stop wherein the second travel stop is located proximate to the longitudinal port.

16. The gas lift valve of claim 15 further comprising an internal charge of gas in fluid communication with the central bore opposite from the longitudinal port.

17. The gas lift valve of claim 16 wherein the bellows contract to open the valve when the external pressure is greater than the pressure of the internal charge of gas and the bellows extend to close the valve when the external pressure is less than the pressure of the internal charge of gas.

18. The gas lift valve of claim 17 further comprising an upper adapter secured to a first end of the bellows and a shoulder on the sleeve, wherein the shoulder limits the contraction of the bellows by contacting the upper adapter.

19. The gas lift valve of claim 17 further comprising a valve stem secured to the lower adapter and a valve seat disposed adjacent to the valve stem, wherein upon extension of the bellows, the valve stem seats in the valve seat, closing the valve and upon contraction of the bellows, the valve stem disengages from the valve seat, opening the valve.

20. The gas lift valve of claim 19 wherein the contact of the valve stem to the valve seat limits the extension of the bellows.

21. The gas lift valve of claim 15 wherein upon contraction of the bellows, the piston travels to the first travel stop, allowing more of the incompressible fluid to move from the interior of the bellows convolutions to the central bore though the fluid port and upon extension of the bellows, the piston travels to the second travel stop, forcing more of the incompressible fluid from the central bore into the interior convolutions of the bellows.

* * * * *

UNITED STATES PATENT AND TRADEMARK OFFICE

CERTIFICATE OF CORRECTION

PATENT NO. : 7,370,706 B2
APPLICATION NO. : 11/278244
DATED : May 13, 2008
INVENTOR(S) : Billy G. Becker et al.

It is certified that error appears in the above-identified patent and that said Letters Patent is hereby corrected as shown below:

Column 1, line 43 replace "fill"

with "full"

Signed and Sealed this

Second Day of December, 2008

JON W. DUDAS
*Director of the United States Patent and Trademark Office*